United States Patent [19]

Yasuda

[11] Patent Number: 5,076,161

[45] Date of Patent: Dec. 31, 1991

[54] STENCIL CARRIER APPARATUS

[75] Inventor: Akira Yasuda, Ushiku, Japan

[73] Assignee: Riso Kagaku Corporation, Tokyo, Japan

[21] Appl. No.: 556,095

[22] Filed: Jul. 23, 1990

[30] Foreign Application Priority Data

Jul. 25, 1989 [JP] Japan ..... 1-86511[U]

[51] Int. Cl.[5] ..... B41L 13/02

[52] U.S. Cl. ..... 101/118; 101/116

[58] Field of Search ..... 101/114, 115, 116, 117, 101/118, 121, 123, 124, 125, 126, 129, 474, 471, 127, 127.1, 128, 128.21, 122, 132.5, 141, 142, 364, 144

[56] References Cited

U.S. PATENT DOCUMENTS

| | | | |
|---|---|---|---|
| 2,778,300 | 7/1953 | Rizerfeld et al. | 101/116 |
| 3,910,184 | 10/1975 | Springer | 101/116 |
| 4,134,338 | 1/1979 | Selman | 101/127.1 |
| 4,628,813 | 12/1986 | Hasegawa et al. | 101/116 |

FOREIGN PATENT DOCUMENTS

| | | | |
|---|---|---|---|
| 115882 | 7/1984 | Japan | 101/116 |
| 61-54708 | 11/1986 | Japan . | |
| 109678 | 5/1987 | Japan | 101/116 |
| 1151587 | 5/1969 | United Kingdom | 101/118 |

*Primary Examiner*—Edgar S. Burr
*Assistant Examiner*—Joseph R. Keating
*Attorney, Agent, or Firm*—Kanesaka and Takeuchi

[57] ABSTRACT

A stencil carrier apparatus including a semi-cylindrical driving feed roller, driven feed rollers, a pressure guide plate, and a control cam enables a used stencil from a printing drum to be reliably transported to a stencil receiver so as to be discharged out of a printing apparatus.

4 Claims, 4 Drawing Sheets

STENCIL CARRIER APPARATUS

BACKGROUND OF THE INVENTION

1. Field of the Invention

This invention relates to a stencil carrier apparatus, and more particularly to a stencil carrier apparatus which is incorporated into a stencil discharging section of a printing apparatus and transports a used stencil from a printing drum to a predetermined position.

2. Description of the Related Art

In a printing apparatus such as a mimeographic printing apparatus or an offset printing apparatus, various types of stencil discharging devices have been heretofore developed so as to automatically remove a used stencil from a printing drum and discharge the same to a pre-determined position.

FIG. 4 of the accompanying drawing shows one of such apparatuses, which is exemplified in Japanese Patent Publication No. 54780/1986. In FIG. 4, a plurality of driven feed rollers 2 are disposed at the bottom of a stencil receiver 1. Above the driven feed rollers 2, there is disposed a substantially semi-cylindrical driving feed roller 3 in such a manner that a driving shaft of the driving roller 3 and a rotary shaft of the driven feed rollers are in parallel with each other. The semi-cylindrical portion of the driving roller 3 is covered with an elastic member 4, through which the driving roller 3 is pressed against the driven feed rollers 2 when the semi-cylindrical portion rotates. Discharge rollers 5 are disposed downstream of the driving feed roller 3, and discharge used stencils into a box, not shown.

With the foregoing structure, while the flat portion of the driving roller 3, contacts with the driven rollers 2, there is a gap wide enough to receive a stencil therein. Under this condition, a used stencil is fed into the gap from a printing drum. Then the driving roller 3 rotates so as to have its semi-cylindrical portion come into pressure contact with the driven rollers 2, thereby causing the used stencil to be taken in between the driving and driven rollers 2 and 3. As the driving roller 3 keeps rotating, the stencil is reliably transported by the frictional resistance between the rollers 2 and 3. Finally, the stencil is discharged into the box, not shown, by the discharge rollers 5.

However, in the conventional stencil carrier apparatus, there has been a problem that the leading edge of the stencil tends to be lifted or curled while the stencil is being carried between the driving roller 3 and the driven rollers 2. Then such a lifted or curled stencil gets into a space between the driving roller 3 and the stencil receiver 1, winds around the driving roller 3, and finally winds around the driving shaft of the driving roller 3. The lifted or curled stencil will not be carried in the desired direction.

SUMMARY OF THE INVENTION

Therefore it is an object of this invention to provide a stencil carrier apparatus, which can prevent the stencils from being wound around the driving shaft of the driving roller, and can reliably carry the stencil to the desired position.

According to this invention there is provided a stencil carrier apparatus comprising: driven feed rollers, a driving feed roller which is in semi-cylindrical shape and transports a used stencil from a printing drum while holding the used stencil in cooperation with the driven rollers, a pressure guide plate which is pushed toward the driven feed rollers in synchronization with rotation of the driving feed roller so as to have the stencil held between the drive feed roller and the driven feed rollers during transportation of the stencil, and a control cam to be operated in synchronization with the driving feed roller and to keep the pressure guide plate pushed toward the driven rollers while a used stencil is being transported by the driving feed roller.

With this arrangement, the pressure guide plate is made of an elastic material, is disposed downstream of the driving feed roller and has a fixed rear end and a free forward end viewed in the feeding direction of the stencil. Further, the driving feed roller is divided by a groove at the center thereof, and a part of the pressure guide plate is positioned in said groove.

The above and other advantages, features and additional objects of this invention will be manifest to those versed in the art upon making reference to the following detailed description and the accompanying drawings in which the principles of this invention are shown by way of illustrative example.

DETAILED DESCRIPTION

Figure 1A:
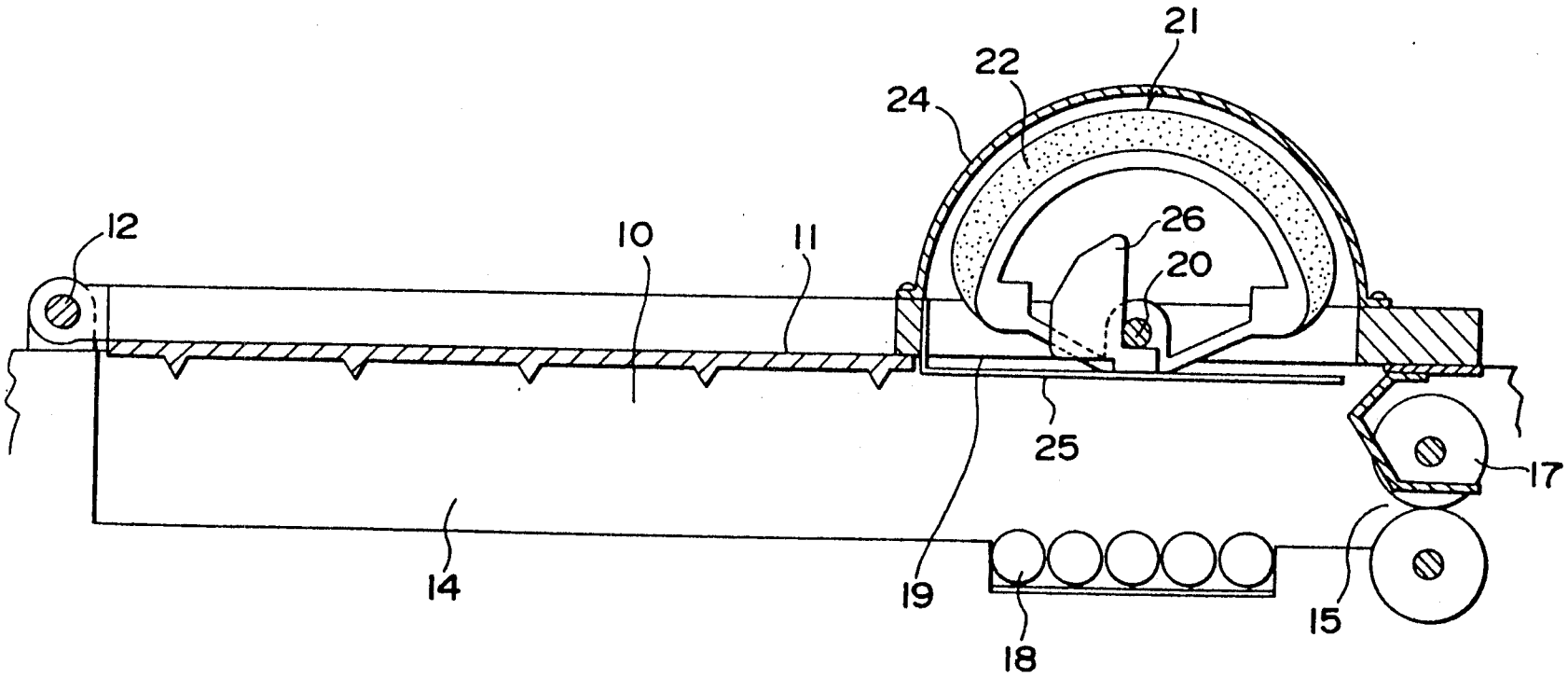
FIGS. 1(*a*) and 1(*b*) are front sectional views of a stencil carrier apparatus according to a preferred embodiment of this invention.
Figure 1B:
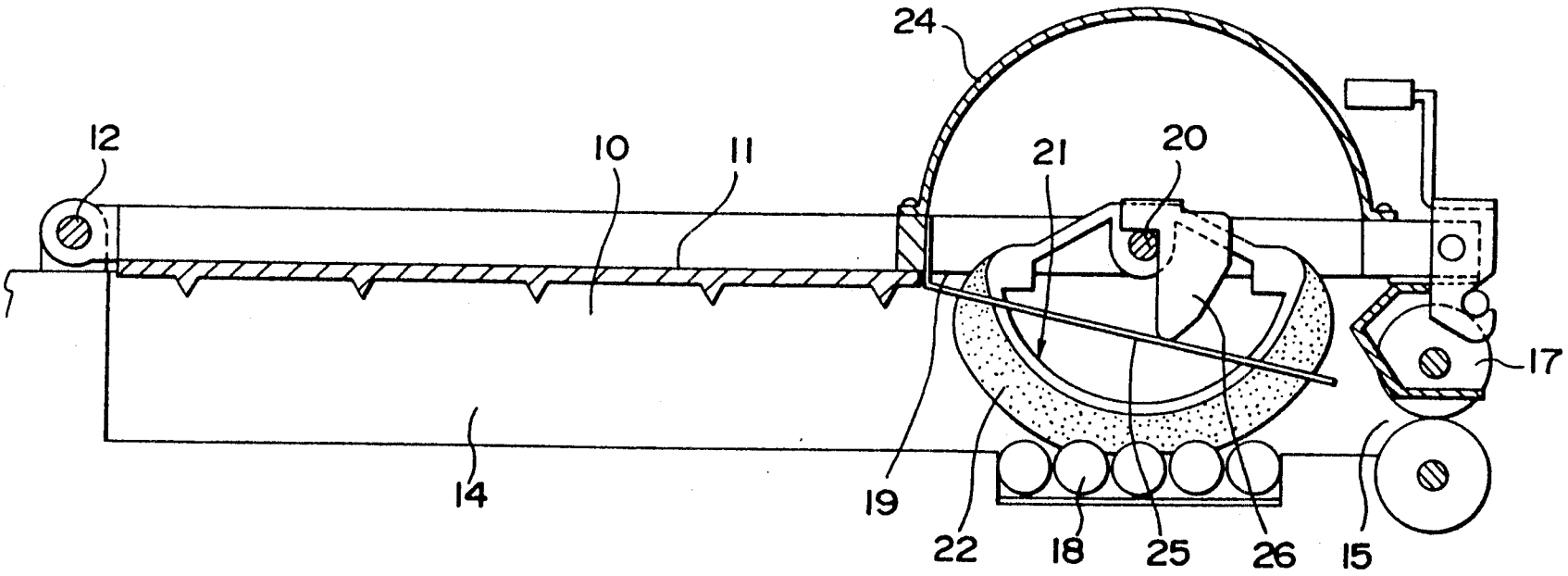
Figure 2:
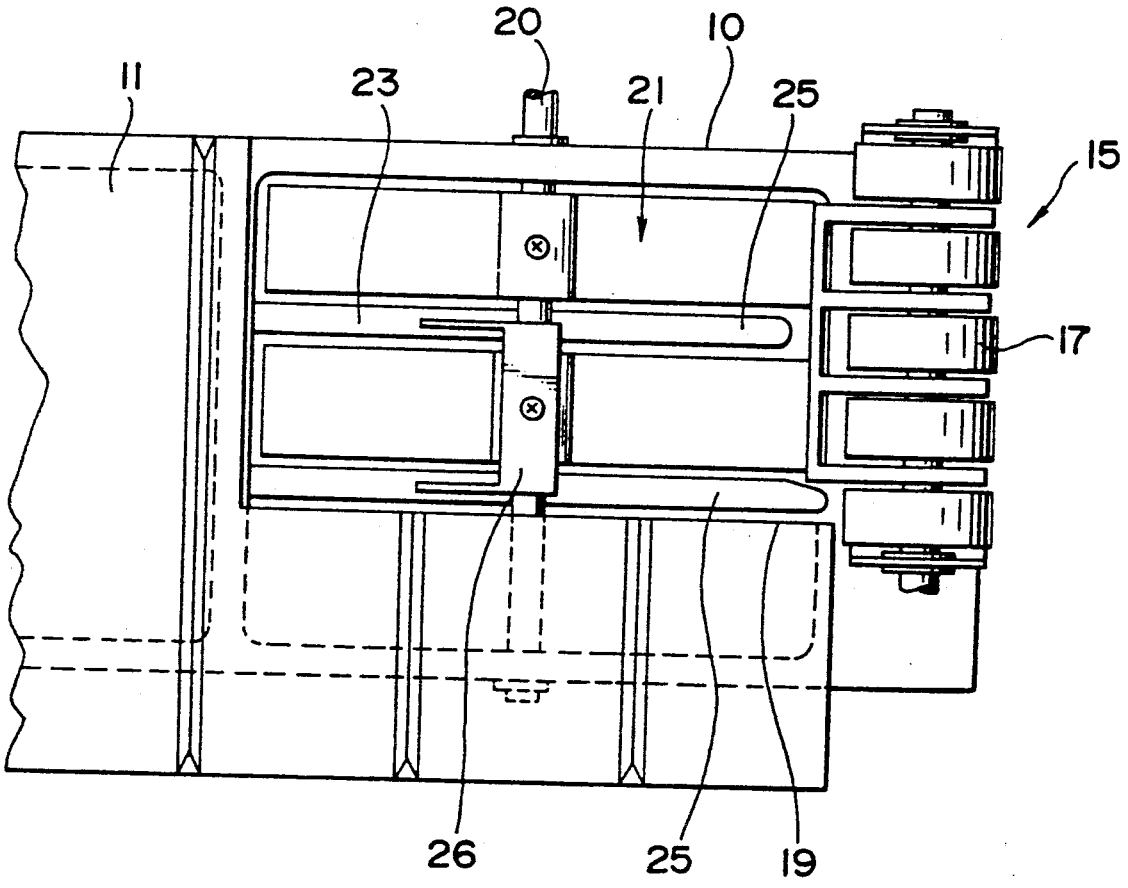
FIG. 2 is a plan view of the apparatus of FIG. 1.
Figure 3:
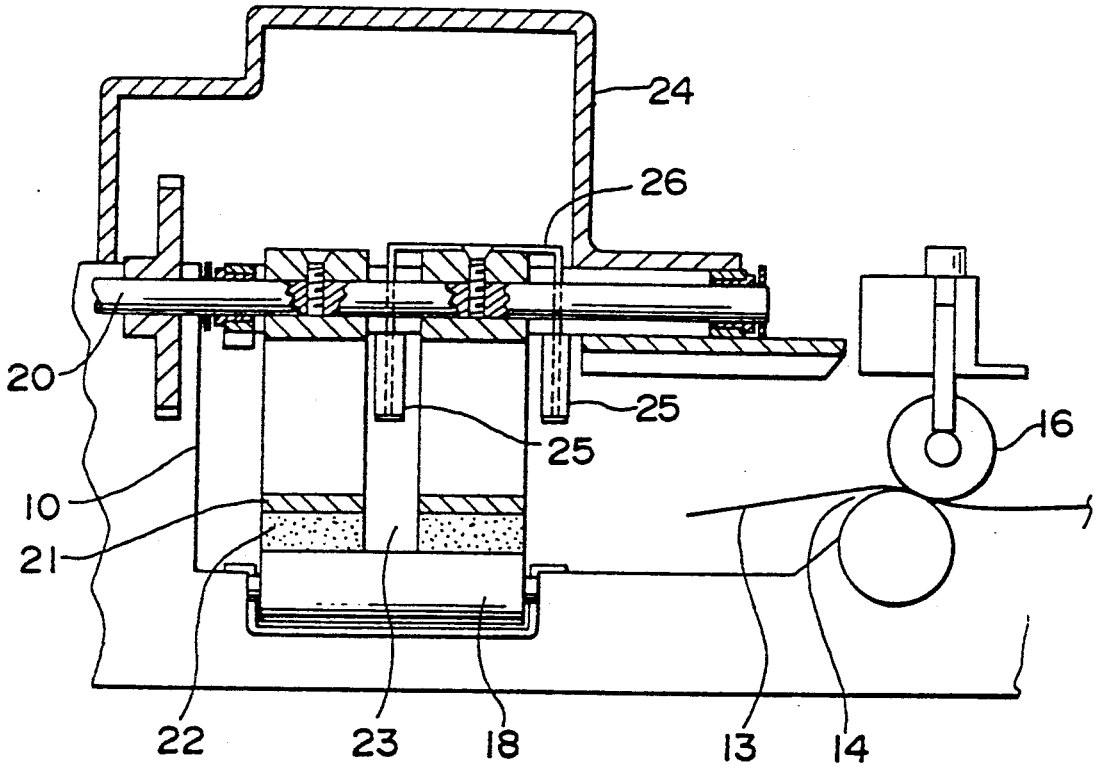
FIG. 3 is a left-side sectional view of the apparatus of FIG. 1.
Figure 4:
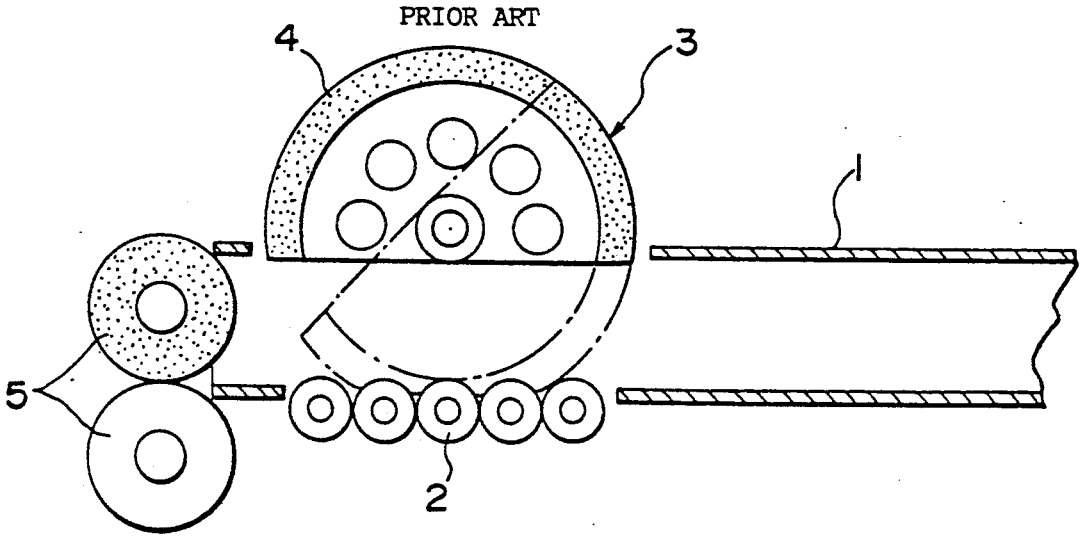
FIG. 4 PRIOR ART
FIG. 4 is a view similar to FIGS. 1(*a*) and 1(*b*), showing an example of the conventional apparatus.

The principles of this invention are particularly useful when embodied in a stencil carrier apparatus, such as shown in FIGS. 1 to 3.

The stencil carrier apparatus according to this invention is used in a stencil discharging apparatus for a mimeographic printing machine. A stencil receiver 10 is attached on a side of the printing machine by means of a hinge 12 located at a ceiling 11. The stencil receiver 10 can be opened and shut. The stencil receiver 10 has an intake port 14 on its front side so as to receive the used stencils, and an outlet port 15 on the right side thereof. As illustrated in FIG. 3, at the intake port 14, there are disposed intake rollers 16 whose axes are in parallel with the printing drum. The intake rollers 16 are arranged so that they can receive the used stencils from the printing drum and transport them to the stencil receiver 10.

As shown in FIG. 1, discharge rollers 17, are disposed at the outlet port 15 perpendicular to the intake rollers 16, so that the used stencil can be discharged into a box (not shown) located outside the stencil receiver.

At the bottom of the stencil receiver 10, a plurality of the driven feed rollers 18 are disposed adjacent the discharge rollers 17 as shown in FIGS. 1 and 2. Rotary shafts of the driven rollers 18 are in parallel with the rotary shafts of the discharge rollers 17. The ceiling 11 is formed with a rectangular opening 19, at which a driving roller 21 is disposed. The driving shaft 20 of the driving roller 21 is in parallel with the driving shafts of the rollers 18 and 17. The driving roller 21 is sector-shaped and has a semi-cylindrical portion covered with an elastic member 22 having a large frictional resistance.

As illustrated in FIGS. 2 and 3, the driving roller 21 is divided into two by a groove 23 at the center thereof in the direction of the drive shaft 20. A semi-cylindrical cover 24 is disposed on the opening 19 of the ceiling 11 under which the driving roller 21 is positioned. The cover 24 covers the driving roller 21 when its semi-cylindrical portion comes upward with the rotation thereof.

As shown in FIGS. 1 and 2, an elongate pressure guide plate 25 made of an elastic material is disposed at the opening 19. The pressure guide plate 25 has length corresponding to the diameter of the driving roller 21, and is positioned horizontally in the groove 23 between the driving roller 21 and the opening 19. Viewed in the stencil feeding direction, the rear end of the guide plate 25 is fixed to the ceiling 11, and the other end of the guide plate 25 is free.

A control cam 26 for controlling the guide plate 25 is fixedly mounted on the drive shaft 20 of the driving roller 21. As the driving roller 21 rotates to carry the stencil, the control cam 26 pushes the guide plate 25 downwards to have it flexed. As can be seen in FIG. 1(*b*), when the driving roller 21 engages with the driven rollers 18 at the lowest position, the pressure guide plate 25 is flexed to the maximum extent by the control cam 26.

Operation and advantages of the stencil carrier apparatus will be described hereinafter.

As illustrated in FIG. 1(*a*), when the slanted portions of the driving roller 21 face the driven rollers 18, a used stencil is removed from the printing drum and is fed into the stencil receiver 10 via the intake rollers 16. Then the driving roller 21 rotates counterclockwise as shown in FIG. 1, and comes into pressure contact with the driven rollers 18 with its semi-cylindrical portion. The used stencil is reliably received between the rollers 21 and 18, and is carried toward the discharge rollers 17. Following the rotation of the driving roller 21, the control cam 26 pushes the pressure guide plate 25 downwardly to the stencil. The pressure guide plate 25 depresses downwardly the leading edge of the stencil held between the driving and driven rollers 18, 21, thereby enabling the stencil to be carried without being lifted or curled, or without being wound around the driving roller 21 or around the drive shaft 20. Then the stencil is transported toward the outlet port 15 of the stencil receiver 10 by the guide of the guide plate 25, and is finally discharged into the box outside the stencil carrier apparatus.

According to the stencil carrier apparatus, since the pressure guide plate is designed so as to hold the stencil downwardly in synchronization with the rotation of the driving roller, it is possible to keep the stencil from being lifted or curled, and to transport the stencil reliably to the pre-determined position.

What is claimed is:

1. A stencil carrier apparatus for transporting a stencil comprising:

driven feed rollers;

a driving feed roller disposed above the driven feed rollers, said driving feed roller having a semi-cylindrical shape and a groove for dividing the driving feed roller into two sections perpendicular to an axis thereof, said driving feed roller holding the stencil together with the driven feed rollers and transporting the stencil;

a control cam operated to synchronize with the driving feed roller; and a pressure guide plate situated in the groove and operated by the control cam, said pressure guide plate being made of an elastic material and having a fixed rear end and a forward end, said pressure guide plate being pushed toward the driven feed rollers by means of the control cam when the stencil is transported by the driving feed roller so that the stencil does not wind around the driving feed roller.

2. A stencil carrier apparatus for transporting a used stencil from a printing machine to a discharge section, comprising:

driven feed rollers disposed on the printing machine;

a driving feed roller situated above the driven feed rollers, said driving feed roller having a shaft, a semi-cylindrical portion formed at one side of the shaft and a groove formed at the semi-cylindrical portion to divide the driving feed roller into two sections perpendicular to the shaft, said semi-cylindrical portion being located away from the driven feed roller when the used stencil is supplied between the driven feed rollers and the driving feed roll, said driving feed roller, after the used stencil is supplied between the driven feed rollers and the driving feed rollers, rotating to hold the used stencil together with the driven feed rollers and transporting the stencil;

a control cam attached to the shaft of the driving feed roller; and a pressure guide plate having a rear end attached to the printing machine and a forward end, said pressure guide plate, when the driving feed roller contacts the driven feed rollers to transport the used stencil, being located in the groove and pushed toward the driven feed rollers by means of the control cam to allow the forward end of the pressure guide plate to project outwardly from the driving feed roller so that the stencil does not adhere to and wind around the driving feed roller and is smoothly led to the discharge section.

3. A stencil carrier apparatus according to claim 2, wherein said pressure guide plate has length longer than diameter of the driving feed roller to allow the used stencil to be separated from the driving feed roller.

4. A stencil carrier apparatus according to claim 3, further comprising a discharge roller, said used stencil transferred by the driving feed roller being fed to the discharge roller.

* * * * *